US010465877B2

(12) United States Patent
Sanchez et al.

(10) Patent No.: US 10,465,877 B2
(45) Date of Patent: Nov. 5, 2019

(54) OPTICAL MODULE INCLUDING A HEAT SINK EQUIPPED WITH A VENT

(71) Applicant: VALEO VISION, Bobigny (FR)

(72) Inventors: Vanesa Sanchez, Bobigny (FR); Lotfi Redjem Saad, Bobigny (FR); Eric Mornet, Bobigny (FR); Francois Berrezai, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 15/923,196

(22) Filed: Mar. 16, 2018

(65) Prior Publication Data

US 2018/0266646 A1 Sep. 20, 2018

(30) Foreign Application Priority Data

Mar. 16, 2017 (FR) ..... 17 52171

(51) Int. Cl.

| | |
|---|---|
| ***F21S 45/48*** | (2018.01) |
| ***F21V 29/60*** | (2015.01) |
| ***F21V 29/83*** | (2015.01) |
| ***F21S 41/143*** | (2018.01) |
| ***F21S 41/20*** | (2018.01) |
| ***F21S 45/43*** | (2018.01) |
| ***F21S 41/153*** | (2018.01) |
| ***F21V 29/67*** | (2015.01) |

(Continued)

(52) U.S. Cl.

CPC ..... *F21S 45/48* (2018.01); *F21S 41/143* (2018.01); *F21S 41/153* (2018.01); *F21S 41/20* (2018.01); *F21S 45/43* (2018.01); *F21V 29/60* (2015.01); *F21V 29/673* (2015.01); *F21V 29/76* (2015.01); *F21V 29/83* (2015.01); *F21S 41/141* (2018.01); *F21S 41/24* (2018.01); *F21S 41/25* (2018.01); *F21S 43/14* (2018.01); *F21S 43/235* (2018.01); *F21Y 2105/12* (2016.08)

(58) Field of Classification Search

CPC ..... F21S 41/141; F21S 41/143; F21S 41/20; F21S 41/24; F21S 45/43; F21S 45/48; F21V 29/60; F21V 29/673; F21V 29/677; F21V 29/76; F21V 29/83; F21Y 2115/10

See application file for complete search history.

(56) References Cited

U.S. PATENT DOCUMENTS 7,427,152 B2 * 9/2008 Erion ..... F21S 41/147 362/547
7,736,026 B2 * 6/2010 Teichgraeber ..... F21V 29/02 362/294

(Continued)

FOREIGN PATENT DOCUMENTS

EP 1 726 874 A1 11/2006
EP 2 733 412 A2 5/2014

(Continued)

*Primary Examiner* — Peggy A Neils

(74) *Attorney, Agent, or Firm* — Oblon, McClelland, Maier & Neustadt, L.L.P.

(57) ABSTRACT

An optical module for a motor vehicle including a light source, a heat sink including a plate having a front face for supporting the light source, and including a rear face spiked with cooling fins, a device for producing an airflow. The heat sink includes at least one vent which passes through the plate of the heat sink in proximity to the light source in order to allow the airflow to circulate longitudinally between the front and the rear of the heat sink.

12 Claims, 5 Drawing Sheets

(51) Int. Cl.

| | |
|---|---|
| ***F21V 29/76*** | (2015.01) |
| ***F21Y 105/12*** | (2016.01) |
| ***F21S 41/25*** | (2018.01) |
| ***F21S 41/24*** | (2018.01) |
| ***F21S 43/14*** | (2018.01) |
| ***F21S 41/141*** | (2018.01) |
| ***F21S 43/235*** | (2018.01) |

(56) References Cited

U.S. PATENT DOCUMENTS

| | | | | |
|---|---|---|---|---|
| 8,337,063 | B2 * | 12/2012 | Nagasawa | B60Q 1/007 362/547 |
| 8,465,189 | B2 * | 6/2013 | Inoue | F21V 29/02 362/547 |
| 8,899,803 | B2 * | 12/2014 | Marley | F21S 41/141 362/516 |
| 9,328,892 | B2 * | 5/2016 | Matsumoto | F21S 41/19 |
| 2007/0035957 | A1 | 2/2007 | Albou et al. | |
| 2008/0212333 | A1 * | 9/2008 | Chen | F21V 29/02 362/373 |
| 2013/0176726 | A1 * | 7/2013 | Yang | F21V 29/004 362/235 |
| 2014/0140085 | A1 | 5/2014 | Matsumoto | |
| 2016/0356448 | A1 | 12/2016 | Puente et al. | |
| 2018/0245757 | A1 * | 8/2018 | Kanayama | F21S 41/19 |

FOREIGN PATENT DOCUMENTS

| | | | |
|---|---|---|---|
| EP | 3 104 063 | A1 | 12/2016 |
| JP | 2008-103195 | | 5/2008 |
| JP | 2010-262903 | | 11/2010 |
| WO | WO 2016/110573 | A1 | 7/2016 |

* cited by examiner

OPTICAL MODULE INCLUDING A HEAT SINK EQUIPPED WITH A VENT

TECHNICAL FIELD OF THE INVENTION

The invention relates to an optical module for a motor vehicle including:

- a light source;
- a heat sink including a plate having a front face for supporting the light source and including a rear face spiked with cooling fins;
- a device for producing an airflow.

TECHNICAL BACKGROUND OF THE INVENTION

Light-emitting diodes are increasingly used as a light source of the optical modules of motor vehicles.

During the operation thereof, these light-emitting diodes radiate heat. The heat produced by the light-emitting diodes can damage some elements of the optical module. This problem is all the more notable since the light sources are generally housed in confined places.

It is therefore known to arrange a finned heat sink at the back of the light-emitting diodes to evacuate the heat therefrom. In order to improve the cooling of the light-emitting diodes, it is known to circulate a cooling airflow between the fins, for example by means of a fan.

If this solution is satisfactory for the majority of configurations, it is however not sufficient when the light source is confined in a particularly cramped housing and/or when elements vulnerable to heat are arranged in immediate proximity to the light source, for example at less than 1 mm from the light source.

BRIEF SUMMARY OF THE INVENTION

The invention proposes an optical module of the type described above, characterized in that the heat sink includes at least one vent which passes through the plate of the heat sink in proximity to the light source in order to allow the airflow to circulate longitudinally between the front and the rear of the heat sink. The direction of the airflow can be either from the light source toward the fins or from the fins toward the light source.

Thus, the vent makes it possible to create an air motion in proximity to the light source. This makes it possible to prevent the air from stagnating on contact with the light source and from heating up to a temperature that risks damaging elements of the optical module. The agitation of the air will, by contrast, prevent the formation of pockets of hot air.

According to other features of the invention:

- the light source is formed by at least one light-emitting diode arranged on a printed circuit board, the printed circuit board being pressed against the front face of the heat sink;
- the light source includes an array of light-emitting diodes;
- the printed circuit board has at least one passage window arranged facing the at least one vent; this particularly makes it possible to bring the airflow as close as possible to the light source; the vent is advantageously positioned such that the airflow causes a suction of the air close to the light-emitting diodes, for example by Venturi effect;
- each vent is covered by at least one deflector which, a mouth of which is open in the direction of the light source generally parallel to the front face of the heat sink; this makes it possible to direct the airflow more precisely toward the light source;
- the deflector is produced integrally with the heat sink;
- the deflector is a piece attached to the heat sink;
- the optical module includes a primary optical element which is arranged in proximity to the light source, a gap being kept between the light source and the primary optical element;
- each deflector is extended by a guide wall for guiding the airflow as far as the gap; this makes it possible to use almost the entirety of the airflow to specifically cool the light source;
- the guide wall is produced integrally with the primary optical element;
- the device for producing the airflow produces an airflow directed from the vent toward the light source; advantageously, the air circulates sufficiently quickly such that the air arriving on the vent has virtually not cooled the fins, the air thus remaining cold;
- the device for producing the airflow produces an airflow which is directed from the light source toward the at least one vent;
- the heat sink includes two vents which are arranged on either side of the light source.

BRIEF DESCRIPTION OF THE FIGURES

Other features and advantages of the invention will emerge when reading the following detailed description, for the comprehension of which reference will be made to the appended drawings wherein.

DETAILED DESCRIPTION OF THE FIGURES

In the remainder of the description, the following orientations will be adopted in a nonlimiting manner:

- longitudinal "L" orientated from the rear to the front along the optical axis of the projection optics of the optical module;
- transverse "T" orientated from left to right;
- vertical "V" orientated from bottom to top.

The vertical orientation "V" is used as a geometric reference without relation to the direction of gravity.

In the remainder of the description, elements having an identical structure and/or similar functions will be designated with the same references.

Figure 1:
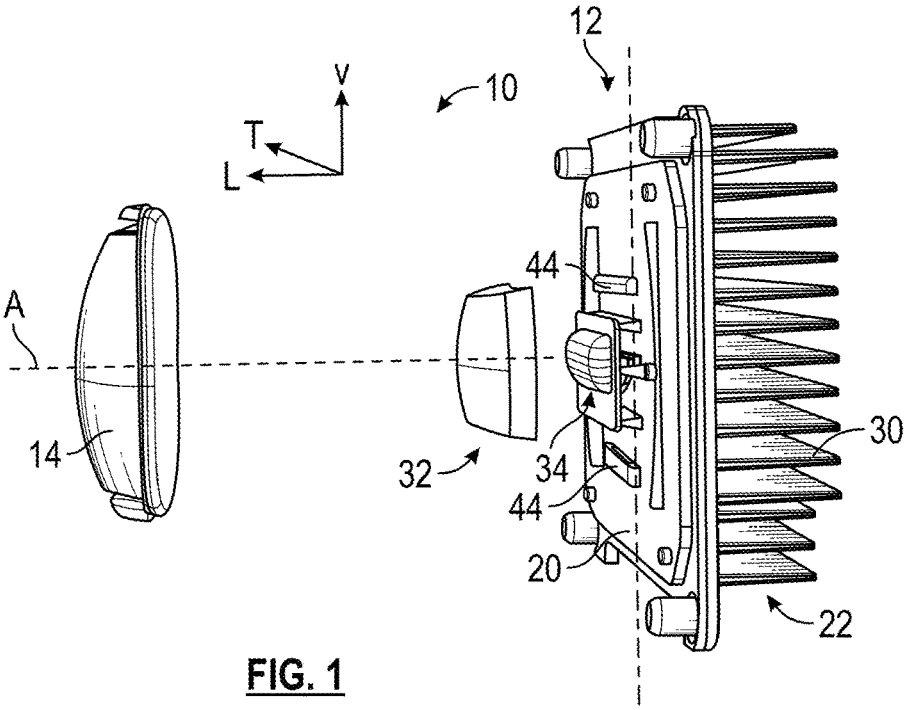
FIG. 1 is a perspective view showing an optical module implementing a first embodiment of the invention.

FIG. 1 shows an optical module 10 which is intended to equip an illuminating or signaling device for a motor vehicle. The optical module 10 is intended to emit a final light beam longitudinally in the forward direction.

By way of nonlimiting example, in this case it is an adaptive light beam which is made up of a plurality of elementary beams which overlap. Such an optical module 10 is particularly suitable for carrying out an adaptive high beam light function, also known as "ADB" meaning "Adaptive Driving Beam", or it is also suitable for carrying out a directional illumination light function, also known as "DBL" meaning "Dynamic Bending Light".

The optical module 10 mainly includes light-emitting means 12 and projection optics 14 that are arranged longitudinally to the front and at a distance from the emitting means 12. The projection optics 14 have a longitudinal optical axis "A".

In an alternative of the invention, that is not shown, the illuminating device further comprises a second low-beam light module which is suitable for emitting a single cut-off low beam.

Figure 2:
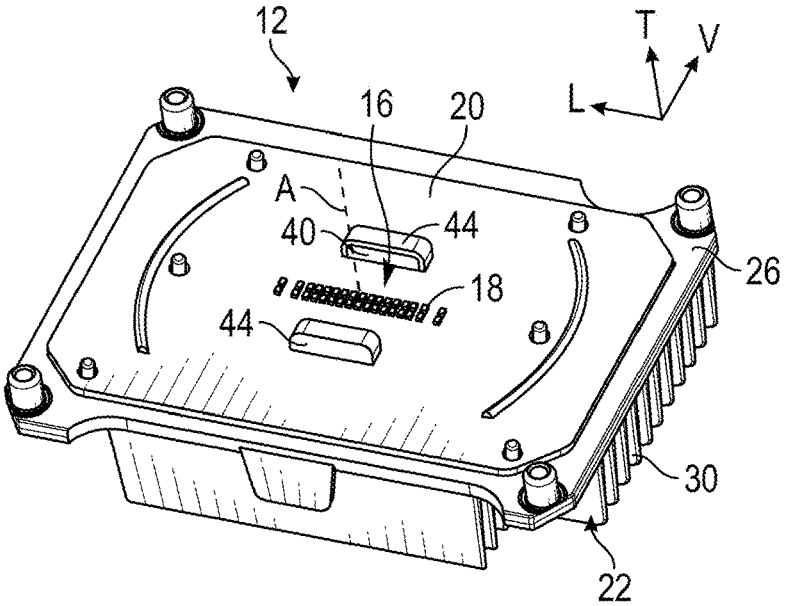
FIG. 2 is a perspective view showing light-emitting means of the module of FIG. 1.

As is shown in greater detail in FIG. 2, the light-emitting means 12 in this case include a light source 16. The light source 16 is formed by at least one light-emitting diode 18 arranged on a printed circuit board 20. The printed circuit board 20 extends in a transverse vertical plane.

The light source 16 in this case is formed by an array of light-emitting diodes 18. The array is equipped with two transverse rows of seventeen light-emitting diodes 18. The optical axis "A" passes substantially in the middle of the array along the transverse direction. The light-emitting diodes 18 are all arranged on said printed circuit board 20.

The array extends in a plane orthogonal to the longitudinal direction "L". More particularly, the light-emitting diodes 18 are borne by the front face of the printed circuit board 20.

The light-emitting diodes 18 in this case can be controlled independently of one another.

In an alternative, the light-emitting diodes 18 are controlled in an interdependent manner, for example in groups of two.

Figure 3:
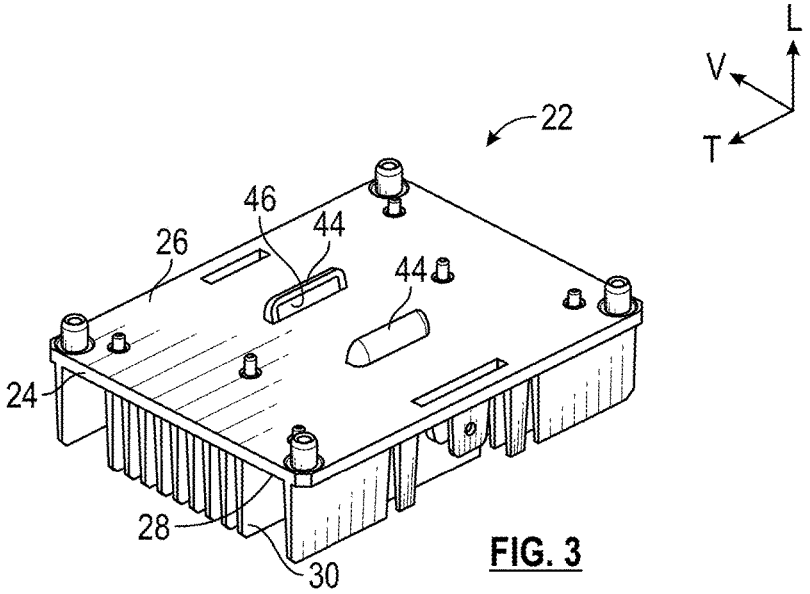
FIG. 3 is a perspective view showing a heat sink of the optical module of FIG. 1.

These light-emitting diodes 18 can emit heat during the operation thereof. The optical module 10 therefore includes a heat sink 22 to evacuate some of the heat by conduction. The heat sink 22 is shown in greater detail in FIG. 3.

The heat sink 22 includes a vertical transverse plate 24 having a front face 26 for supporting the light source 16 and a rear face 28. The heat sink 22 also includes cooling fins 30 which spike the rear face 28 of the plate 24.

The back of the printed circuit board 20 is pressed against the front face 26 of the heat sink 22 such as to transmit some of the produced heat by conduction to the heat sink 22. A layer of thermal paste (not shown) is, for example, squashed between the printed circuit board 20 and the front face 26 of the heat sink 22 in order to promote the heat exchange between the printed circuit board 20 and the heat sink 22. The printed circuit board 20 is more particularly arranged against a central area of the front face 26 of the heat sink 22 in order to promote the cooling thereof.

The cooling fins 30 make it possible to increase the surface for exchange between the heat sink 22 and the air external to the optical module 10. The cooling fins 30 extend longitudinally from the rear face 28 of the plate 24. These are, in a nonlimiting manner, parallel transverse fins 30.

The optical module 10 includes a first primary optical element 32 which is arranged longitudinally in front of the array 16 of light-emitting diodes 18 in order to change the distribution of the light rays emitted by the light-emitting diodes 18.

Figure 4:
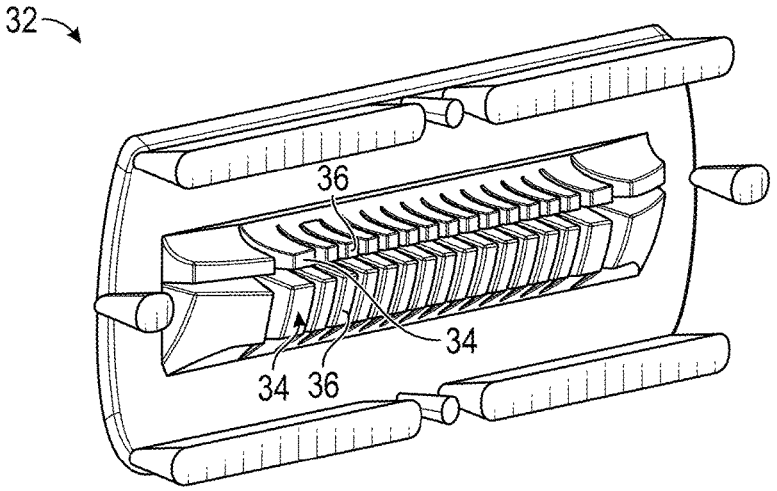
FIG. 4 is a perspective view on a larger scale showing a primary optical element of the optical module of FIG. 1 which is intended to be arranged in immediate proximity to the light source.

As shown in FIG. 4, the primary optical element 32 in this case includes a rear portion which is formed from a plurality of light guides 34. Each light guide 34 extends along a longitudinal main axis from a face 36 for inlet of the light rays, as far as a front portion of the primary optical element 32. Each light guide 34 is designed to guide the rays entering via the inlet faces 36 as far as the front portion of the primary optical element 32.

The primary optical element 32 includes an array of at least as many light guides 34 as there are light-emitting diodes 18 included in the array 16. Each light guide 34 is associated with a light-emitting diode 18.

Figure 5:
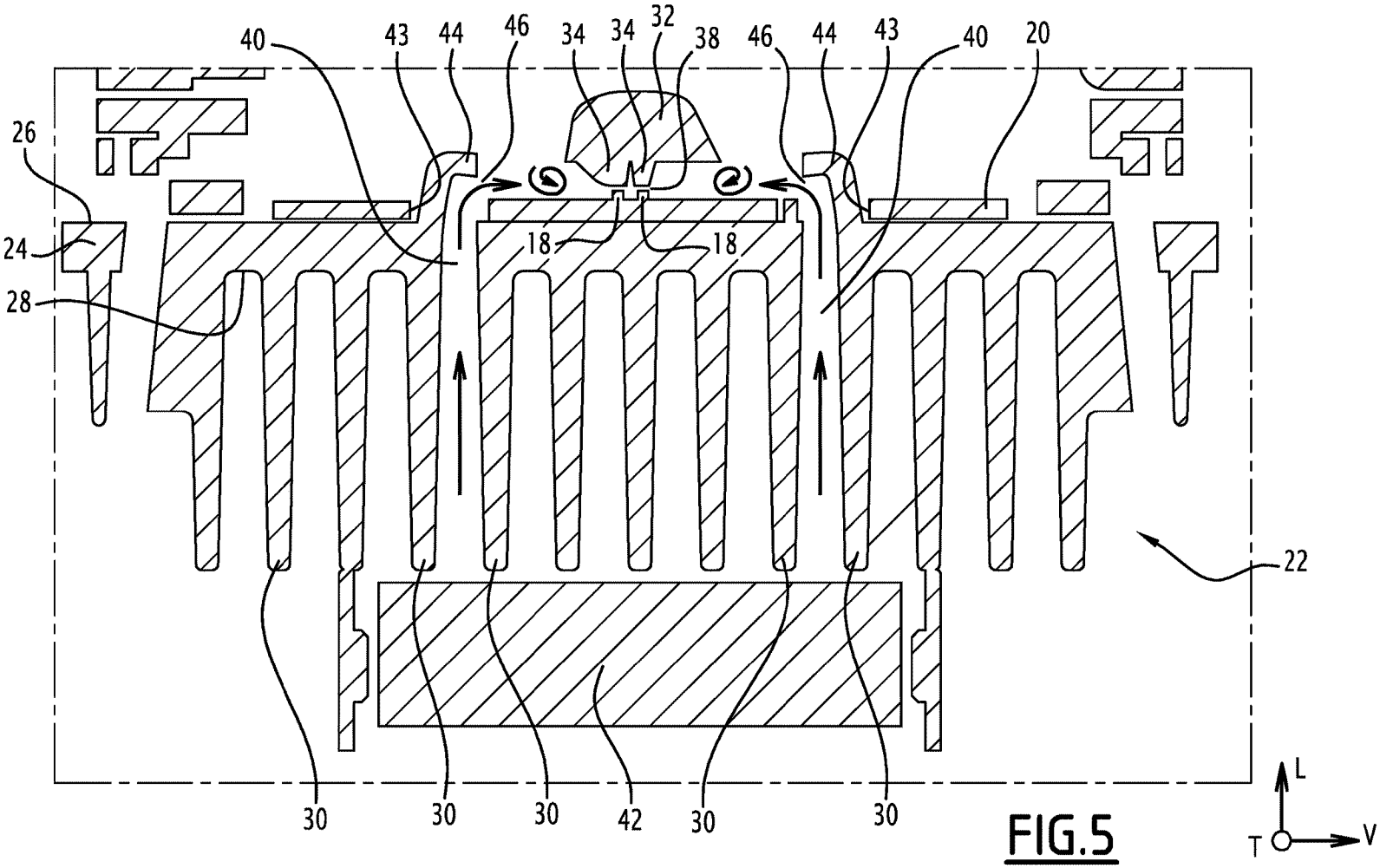
FIG. 5 is a sectional view along the cutting plane 5-5 of FIG. 6 which shows the optical module including the heat sink supplied with vents produced according to the first embodiment of the invention.
Figure 6:
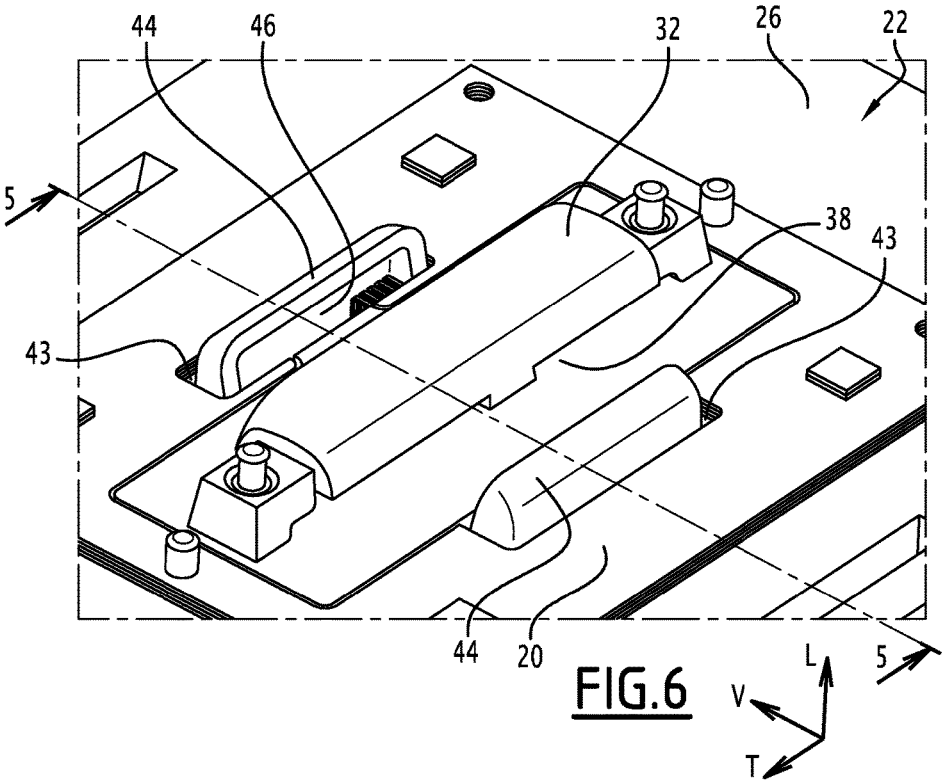
FIG. 6 is a perspective view which illustrates the front face of the heat sink on which a printed circuit board and the primary optical element are mounted.

The inlet faces 36 of the light guide 34 are arranged in a common plane which is parallel to the plane of the printed circuit board 20. When the primary optical element 32 is arranged in the optical module 10, as is shown in FIGS. 5 and 6, each inlet face 36 is thus positioned longitudinally opposite an associated light-emitting diode 18 such that the majority of the light rays emitted by each light-emitting diode 18 enters the associated light guide 34.

Each inlet face 36 is more particularly arranged at a small longitudinal distance from the associated light-emitting diode 18, for example at less than 1 mm, or even at less than 0.5 mm. A gap 38 is thus kept longitudinally between each light-emitting diode 18 and the primary optical element 32.

In such a context, the air confined in the gap 38 between the array of light-emitting diodes 18 and the primary optical element 32 is heated by the radiation of the light-emitting diodes 18. Due to the small dimensions of the gap 38, the air confined in this manner is not renewed and continues to heat up. The heat sink 22 does not make it possible to evacuate enough heat in order to cool the confined air.

It has been particularly noted that, in some cases, the air could heat up until reaching a critical temperature which is sufficiently high to alter the physical integrity of the material forming the primary optical element 32. This is, for example, the case when the primary optical element 32 is made from silicone and the temperature exceeds the critical temperature, for example 100° C.

To solve this problem and evacuate the hot air confined in the gap 38, the invention proposes a heat sink 22 including at least one vent 40 which passes through the plate 24 of the heat sink 22 in proximity to the light source 16. The vent 40 is in the form of a hole which passes right through the plate 24 in the direction of the thickness and which opens between two fins 30.

The optical module 10 further includes a device 42 for producing an airflow which makes it possible to longitudinally circulate an airflow through the vent 40 between the rear face 28 and the front face 26 of the heat sink 22. The circulation of air makes it possible to create a forced convective motion which makes it possible to at least partially renew the air in the gap 38. Such a device 42 will be described in greater detail hereafter.

For example, the vents 40 are positioned such that the airflow produces a suction of the air close to the light-emitting diodes by using the Venturi effect for example.

The heat sink 22 is produced as a single piece, for example by molding. It is produced from a rigid and heat conducting material, such as a metal material, for example steel. The vent 40 can be produced directly during molding or by machining the heat sink 22.

Each vent 40 is, in this case, produced in a central area of the heat sink 22 such as to be located in proximity to the light-emitting diodes 18. For the vents 40 to be arranged as close as possible to the array of light-emitting diodes 18, in the example shown in FIG. 6, the printed circuit board 20 has at least one passage window 43 arranged facing the at least one vent 40. Thus, the airflow comes out as close as possible to the light-emitting diodes 18, by passing through the printed circuit board 20.

Moreover, in order to promote the agitation of the air in the gap 38, it is envisaged that each vent 40 is covered by at least one deflector 44, a mouth 46 of which is open in the direction of the light source 16 generally parallel to the front face 26 of the heat sink 22. Thus, the movement of air in the vent 40 will cause an air motion parallel to the front face 26 of the heat sink 22 as far as the gap 38.

FIG. 5 shows a first embodiment of the invention. The array of light-emitting diodes 18 has a length which extends transversally over the printed circuit board 20. Two vents 40 are vertically arranged on either side of the array. Each vent 40 has, in section, a transversally elongated shape. The length of the section of each vent 40 is at least equal to the length of the area to be cooled.

In an alternative, several vents having a shorter section are arranged on each side of the area to be cooled.

In the present case, only the mid-area of the array of light-emitting diodes 18 can reach the critical temperature. Each vent 40 therefore has a length section less than that of the array, but greater than that of the mid-area to be cooled.

Each vent 40 advantageously has a passage section, the area of which is limited to a few millimeters squared in order to allow the acceleration of the air when it passes through the vent 40 by Bernouilli effect. The width of the section is, for example, between 1 and 4 mm.

Figure 7:
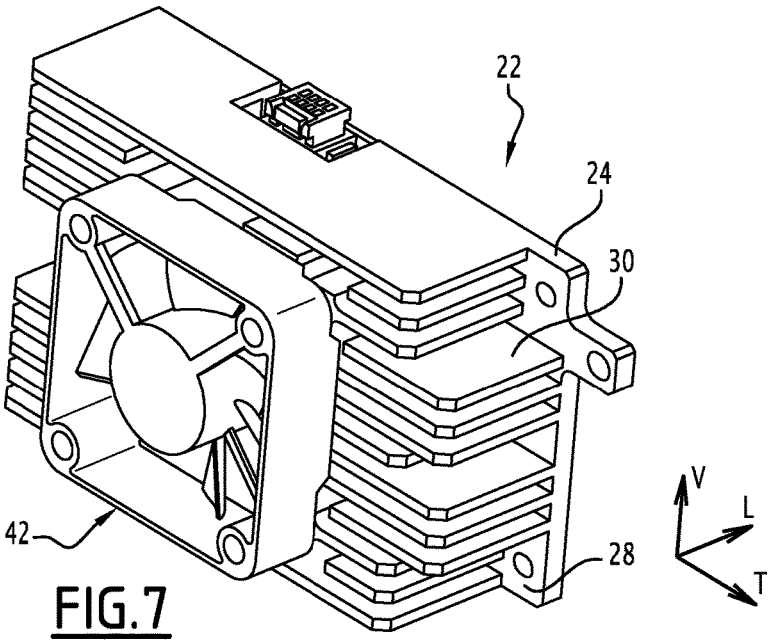
FIG. 7 is a perspective view which shows a rear face of the heat sink of FIG. 5 equipped with a fan.

The airflow is, in this case, produced by a fan 42 which is arranged against the free end of the fins 30, as is shown in FIGS. 5 and 7. Thus, a first part of the airflow produced by the fan 42 makes it possible to contribute to the cooling of the fins 30, whereas a second part of the airflow enters the vents 40 in order to come out in proximity to the light-emitting diodes 18.

Advantageously, the airflow second part directed toward the vents 40 circulates such as to virtually not cool the fins 30. Thus, the air which enters the vents 40 is hardly heated by the fins 30.

As shown in FIG. 5, the faces of the fins 30 that border the vents 40 advantageously have a shape that guides some of the airflow in the direction of the vents 40 in order to promote the streaming speed of the air in the vents 40. In the example shown in FIG. 5, the walls of each vent 40 thus extend the guide face of the associated fins 30, without the presence of an indentation or shoulder that can disrupt the air stream.

Each vent 40 is covered by a deflector 44 which orientates the airflow vertically in the direction of the gap 38. Each deflector 44 thus extends longitudinally such as to project with respect to the printed circuit board 20.

The deflector 44 is, in this case, produced as a single piece integrally with the heat sink 22. In this case, the deflectors 44 pass through the windows 43 of the printed circuit board 20.

In an alternative, the deflector 44 is an attached piece. The deflector 44 is, for example, fixed on the printed circuit board 20.

The device 42 for producing the airflow thus produces an airflow directed from the vent 40 toward the light source. The path of the airflow is indicated by the arrows of FIG. 5. The fresh air blown through each vent 40 by the fan 42 thus expels the hot air contained in the gap 38. This constant convective motion thus makes it possible to keep the temperature of the mid-area of the light-emitting diodes 18 below the critical temperature, thus preserving the integrity of the primary optical element 32.

Figure 8:
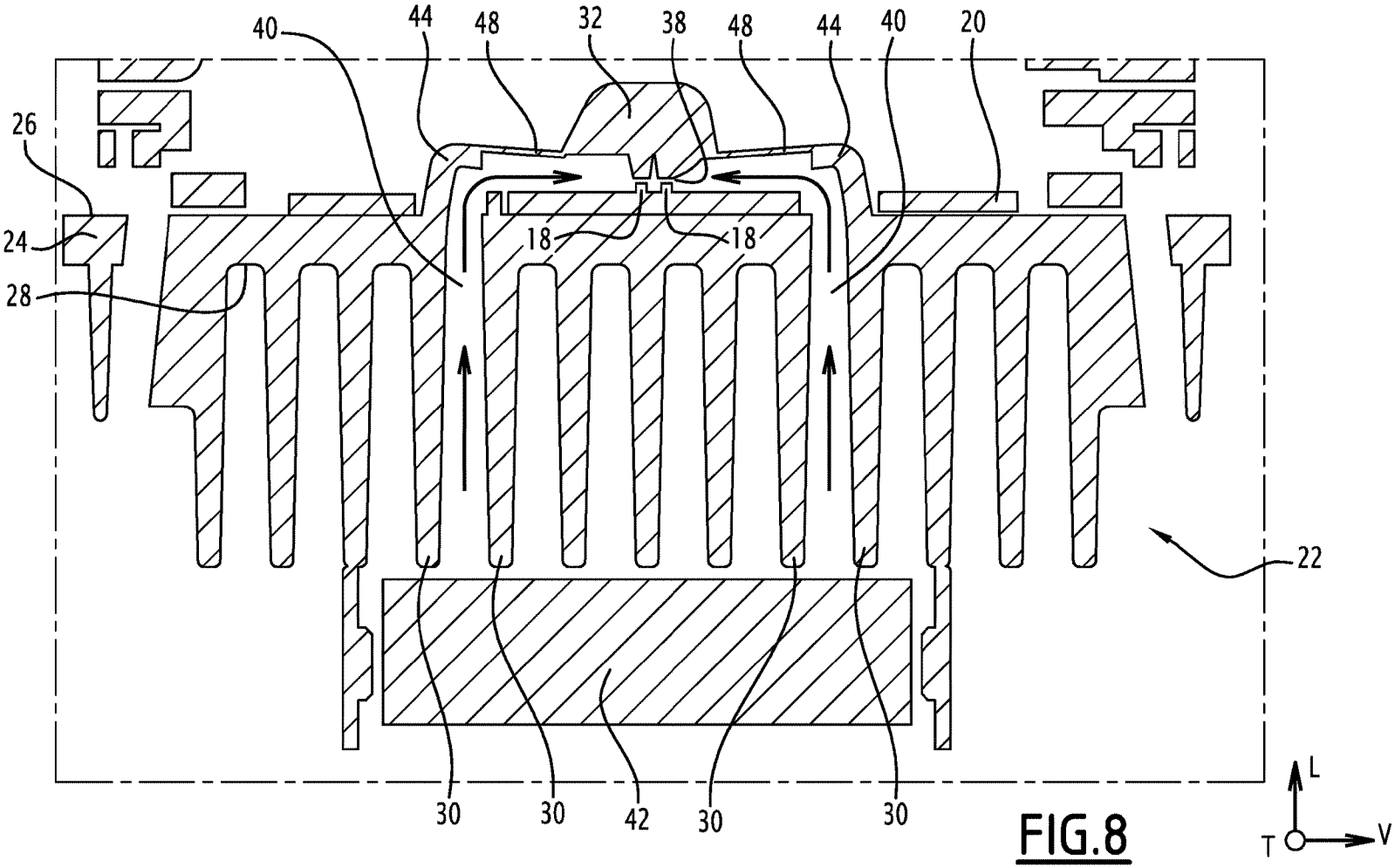
FIG. 8 is a view similar to that of FIG. 5 which shows a second embodiment of the invention.

A second embodiment of the invention has been shown in FIG. 8. The optical module 10 according to this second embodiment has many similarities with the optical module 10 produced according to the first embodiment. Only the differences, in this case relating to the deflectors 44, will be described hereafter.

Each deflector 44 is extended by a guide wall 48 until contacting the primary optical element 32 in order to lead the airflow as far as the gap 38, as is indicated by the arrows of FIG. 8. This allows almost the entire air volume passing through the vents 40 to enter the gap 38. The cooling effect is therefore maximized.

Just like in the first embodiment, the deflector 44 is, for example, produced integrally with the heat sink 22.

In an alternative, the deflector 44 is produced as a piece that is attached to the printed circuit board 20.

The guide wall 48 is produced integrally with the primary optical element 32.

According to an alternative of this second embodiment, which alternative is not shown, the deflector 44 and the guide wall 48 are produced as a common single piece.

According to another alternative embodiment of the invention which can be used for either of the first two embodiments, the device 42 for producing an airflow, for example the fan 42, sucks air through the vent 40. In this case, there is an effect of sucking the hot air contained in the gap 38 through the mouth 46 of the deflector 44. The device 42 for producing the airflow thus produces an airflow which is directed from the light source 16 toward the at least one vent 40. This alternative embodiment is particularly effective when it is combined with the second embodiment.

According to another alternative of the invention, that is not shown, the device 42 for producing an airflow is arranged such as to blow air directly in the direction of the gap 38, without passing via the vents 40. The air which is actively put in motion on the front face 26 side of the heat sink 22 is thus naturally evacuated by the vents 40.

The optical module 10 produced according to the teachings of the invention thus makes it possible to effectively cool the primary optics by putting into motion the air contained in the gap 38.

The invention claimed is:

1. Optical module for a motor vehicle including:

a light source;

a heat sink including a plate having a front face for supporting the light source and including a rear face spiked with cooling fins;

a device for producing an airflow; and a primary optical element which is arranged in proximity to the light source, a gap being kept between the light source and the primary optical element, wherein:

the heat sink includes at least one vent which passes through the plate of the heat sink in proximity to the light source in order to allow the airflow to circulate longitudinally between the front and the rear of the heat sink, each vent is covered by at least one deflector a mouth of which is open in the direction of the light source generally parallel to the front face of the heat sink, each deflector is extended by a guide wall for guiding the airflow as far as the gap, and the guide wall is produced integrally with the primary optical element.

2. Optical module according to claim 1, wherein the light source is formed by at least one light-emitting diode arranged on a printed circuit board, the printed circuit board being pressed against the front face of the heat sink.

3. Optical module according to claim 2, wherein the light source includes an array of light-emitting diodes.

4. Optical module according to claim 3, wherein the printed circuit board has at least one passage window arranged facing the at least e vent.

5. Optical module according to claim 1, wherein the deflector is produced integrally with the heat sink.

6. Optical module according to claim 1, wherein the deflector is a piece attached to the heat sink.

7. Optical module according to claim 1, wherein the device for producing the airflow produces an airflow directed from the vent toward the light source.

8. Optical module according to claim 1, wherein the device for producing the airflow produces an airflow which is directed from the t toward the at least one vent.

9. Optical module according to claim 1, wherein the heat sink includes two vents which are arranged on either side of the light source.

10. Optical module according to claim 2, wherein the device for producing the airflow produces an airflow directed from the vent toward the light source.

11. Optical module according to claim 2, wherein the device for producing the airflow produces an airflow which is directed from the light source toward the at least one vent.

12. Optical module according to claim 2, wherein the heat sink includes two vents which are arranged on either side of the light source.

* * * * *